US009758333B2

(12) United States Patent
Weng et al.

(10) Patent No.: US 9,758,333 B2
(45) Date of Patent: Sep. 12, 2017

(54) ROTARY PAPER MONEY CONVEYING DEVICE

(71) Applicant: GRG BANKING EQUIPMENT CO., LTD., Guangzhou, Guangdong (CN)

(72) Inventors: Qiuhua Weng, Guangdong (CN); Dong Tan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/504,580

(22) PCT Filed: Jul. 27, 2015

(86) PCT No.: PCT/CN2015/085185

§ 371 (c)(1),
(2) Date: Feb. 16, 2017

(87) PCT Pub. No.: WO2016/026369

PCT Pub. Date: Feb. 25, 2016

(65) Prior Publication Data

US 2017/0233202 A1 Aug. 17, 2017

(30) Foreign Application Priority Data

Aug. 20, 2014 (CN) ..... 2014 1 0413596

(51) Int. Cl.
*B65H 29/10* (2006.01)
*G07F 19/00* (2006.01)

(52) U.S. Cl.
CPC ..... *B65H 29/10* (2013.01); *G07F 19/202* (2013.01); *G07F 19/203* (2013.01);
(Continued)

(58) Field of Classification Search
CPC ..... B65H 29/003; B65H 29/10; B65H 29/28; B65H 2301/44338; B65H 2301/4471;
(Continued)

(56) References Cited

U.S. PATENT DOCUMENTS

2005/0230898 A1 10/2005 Suqiyama et al.
2007/0000993 A1 1/2007 Graef et al.
2008/0142583 A1 6/2008 Yokoi et al.

FOREIGN PATENT DOCUMENTS

CN 1683227 A 10/2005
CN 101188029 A 5/2008
(Continued)

OTHER PUBLICATIONS

International Search Report for PCT/CN2015/085185, mailed Nov. 3, 2015, ISA/CN.

*Primary Examiner* — Michael McCullough
(74) *Attorney, Agent, or Firm* — Yue Xu; U.S. Fairsky LLP

(57) ABSTRACT

A rotary paper money conveying device applied to a note in and out port (1) of an automatic teller machine. The rotary paper money conveying device comprises: a paper money clamping mechanism (10), used for clamping and conveying paper money (200) from the note in and out port (1) to a paper money transportation channel entrance inside the automatic teller machine; a transmission mechanism, comprising a drive motor (30), a belt (32) and a pair of belt pulleys (31, 33), wherein the belt (32) is fixed to the paper money clamping mechanism (10) through a shaft and a bearing and used for conveying the paper money clamping mechanism (10) to the paper money transportation channel entrance from the note in and out port (1); a first rotary driving mechanism, comprising a first rotary motor (20) and a first transmission gear (22) and used for driving the paper money clamping mechanism (10) to rotate by a first angle at
(Continued)

the note in and out port (1); a second rotary driving mechanism, comprising a second rotary motor (40) and a second transmission gear (42) and used for driving the paper money clamping mechanism (10) to rotate by a second angle at the paper money transportation channel entrance; and a central control mechanism.

6 Claims, 4 Drawing Sheets

(52) U.S. Cl.
CPC ..... *B65H 2301/4224* (2013.01); *B65H 2301/42242* (2013.01); *B65H 2301/44338* (2013.01); *B65H 2405/52* (2013.01); *B65H 2701/1912* (2013.01)

(58) Field of Classification Search
CPC .. B65H 2301/4224; B65H 2301/42242; B65H 2405/50; B65H 2405/52; B65H 2405/53; B65H 2405/584; B65H 2511/212; B65H 2701/1912; G07F 19/202; G07F 19/203; G07D 11/0018
See application file for complete search history.

(56) References Cited

FOREIGN PATENT DOCUMENTS

| | | | |
|---|---|---|---|
| CN | 101213553 | A | 7/2008 |
| CN | 102502002 | A | 6/2012 |
| CN | 102622819 | A | 8/2012 |
| CN | 103274071 | A | 9/2013 |
| CN | 103971467 | A | 8/2014 |
| CN | 104157074 | A | 11/2014 |
| EP | 0471300 | A2 | 2/1992 |
| EP | 3006353 | A1 | 4/2016 |
| JP | S62222946 | A | 9/1987 |
| JP | H02266491 | A | 10/1990 |
| JP | 2000331214 | A | 11/2000 |
| JP | 2001312760 | A | 11/2001 |
| JP | 2008165690 | A | 7/2008 |
| KR | 20100047786 | A | 5/2010 |
| WO | 2006099004 | A2 | 9/2006 |

ROTARY PAPER MONEY CONVEYING DEVICE

This application is the national phase of International Application No. PCT/CN2015/085185, titled "ROTARY PAPER MONEY CONVEYING DEVICE", filed on Jul. 27, 2015, which claims the benefit of priority to Chinese patent application No. 201410413596.8, titled "ROTARY BANKNOTE CONVEYING DEVICE", filed with the Chinese State Intellectual Property Office on Aug. 20, 2014, the entire disclosures of which are incorporated herein by reference.

FIELD

The present application relates to the banknote processing technology, and particularly relates to a banknote receiving device.

BACKGROUND

With the continuous development of the economy, the banknote processing load continuously increases, and the requirement for processing capacity of banknote processing apparatuses is improved accordingly. Currently, banknote processing apparatuses generally used main include an automatic banknote depositing and withdrawing machine, a dispenser, and the like. In these apparatuses, banknote receiving and dispensing devices are widely used.

Currently, banknote conveying mechanisms widely used in the banknote receiving and outputting devices have a defect of having a complex structure, for example, a motor is used to control the opening and closing of a clamping mechanism, and a rack and a gear are used to convey the clamping mechanism, and these mechanisms have complex configurations, and are apt to cause failures such as mechanism jamming.

SUMMARY

For addressing the issue in the conventional technology that the banknote conveying mechanism has a complex structure, a rotary banknote conveying device is provided according to the present application, which conveys banknotes from a banknote inlet/outlet into a banknote conveying passage inside an apparatus by means of rotating the banknotes by a certain angle, and the rotary banknote conveying device has a simple structure and is easy to control.

A rotary banknote conveying device is applicable to a banknote inlet/outlet of an automatic teller machine and includes a banknote clamping mechanism configured to convey banknotes from the banknote inlet/outlet to an inlet of a banknote conveying passage inside the automatic teller machine; a transmission mechanism including a drive motor, a belt and a pair of pulleys, the belt being fixed to the banknote clamping mechanism by a shaft and a bearing and configured to convey the banknote clamping mechanism from the banknote inlet/outlet to the inlet of the banknote conveying passage; a first rotary driving mechanism including a first rotary motor and a first transmission gear and configured to drive the banknote clamping mechanism to rotate by a first angle at the banknote inlet/outlet; a second rotary driving mechanism including a second rotary motor and a second transmission gear and configured to drive the banknote clamping mechanism to rotate by a second angle at the inlet of the banknote conveying passage; and a central control mechanism including a control unit, a first position sensor configured to assist in controlling the first rotary driving mechanism to drive the banknote clamping mechanism to rotate by the first angle, and a second position sensor configured to assist in controlling the second rotary driving mechanism to drive the banknote clamping mechanism to rotate by the second angle.

Preferably, the banknote clamping mechanism is provided with a transmission gear, and the transmission gear is configured to engage with the first transmission gear or the second transmission gear, to drive the banknote clamping mechanism to rotate by the first angle or the second angle.

Preferably, the banknote clamping mechanism further includes an opening end and a rear end opposite to the opening end, the rear end is provided with a spring and a electromagnetic sequentially, the electromagnetic is configured to control the banknote clamping mechanism to close in a state that the electromagnetic is energized, and the spring is configured to control the banknote clamping mechanism to open in a state that the electromagnetic is de-energized.

Specifically, the inlet of the banknote conveying passage includes a fixed pressing plate, a movable pressing plate and a pair of banknote separating wheels, the fixed pressing plate and the movable pressing plate define a banknote stacking space, and the pair of banknote separating wheels are driven by a step motor to separate the banknotes in the banknote stacking space individually and deliver the banknotes into the banknote conveying passage.

Compared with the conventional technology, the banknote conveying device according to the present application achieves the conveying of the clamping mechanism by the step motor and the synchronous belt, and has a higher stability and a higher accuracy compared with a conventional gear-rack transmission. Further, the closing and opening of the clamping mechanism are controlled by the electromagnetic and the spring, thereby eliminating the conventional motor control method and the like, thus the cost is lower, and the reliability is higher.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION

Technical solutions of embodiments of the present application will be clearly and completely described hereinafter in conjunction with the drawings of the embodiments according to the present application. Apparently, the embodiments described are only some examples of the present application, and not all implementations. Other embodiments obtained by the person skilled in the art based on the embodiments of the present application without any creative efforts all fall into the scope of protection of the present application.

Figure 1:
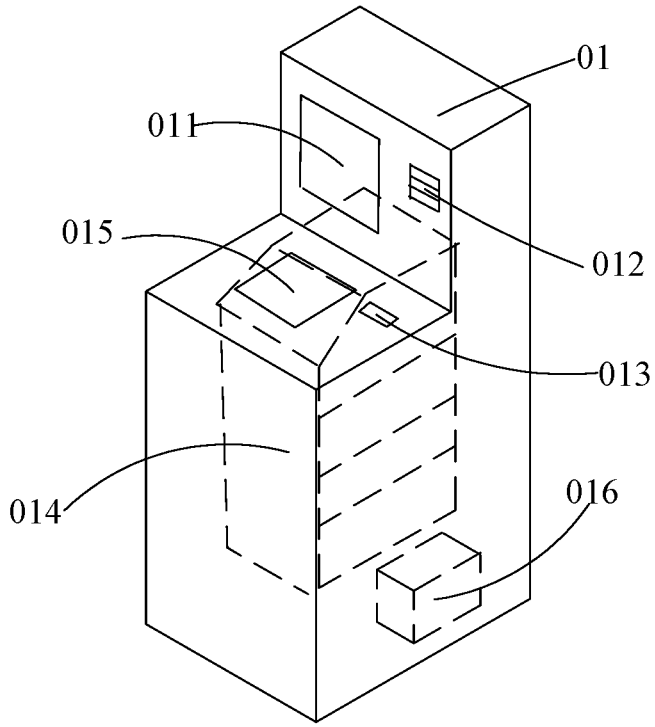
FIG. 1 is a schematic view showing the structure of an automatic banknote depositing and withdrawing machine equipped with this embodiment.

Reference is made to FIG. 1 which is a schematic view of the structure of an automatic banknote depositing and withdrawing machine in which a rotary banknote conveying device according to this embodiment is applied. The automatic banknote depositing and withdrawing machine 01 includes a display device 011, a card and detailed statement processing device 012, an input device 013, a banknote processing device 014, a banknote inlet/outlet 015 and a main control device 016. In addition, the automatic banknote depositing and withdrawing machine 01 further includes other various devices, however, illustrations and descriptions for them are omitted.

Figure 2:
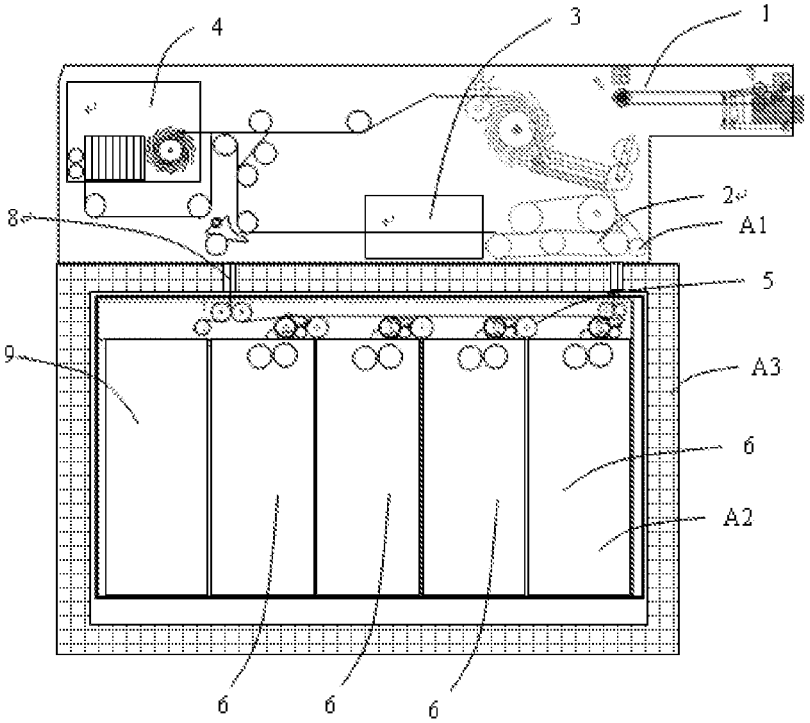
FIG. 2 is a schematic view showing the structure of a banknote processing device of the automatic banknote depositing and withdrawing machine in FIG. 1.

Reference is made to FIG. 2 which is a schematic view showing the structure of a machine core of the automatic banknote depositing and withdrawing machine 01. The banknote processing device 014 of the automatic banknote depositing and withdrawing machine may be generally divided into an upper module A1, a lower module A2, and a cashbox A3, and the lower module A2 is arranged in the cashbox A3. The upper module mainly includes a banknote inlet/outlet 1, a banknote conveying passage 2, a banknote identifier 3, a temporarily storage region 4, and etc. The lower module mainly includes a lower conveying passage 5, a depositing banknote box 9, a cycling banknote box 6 and etc.

Figure 3:
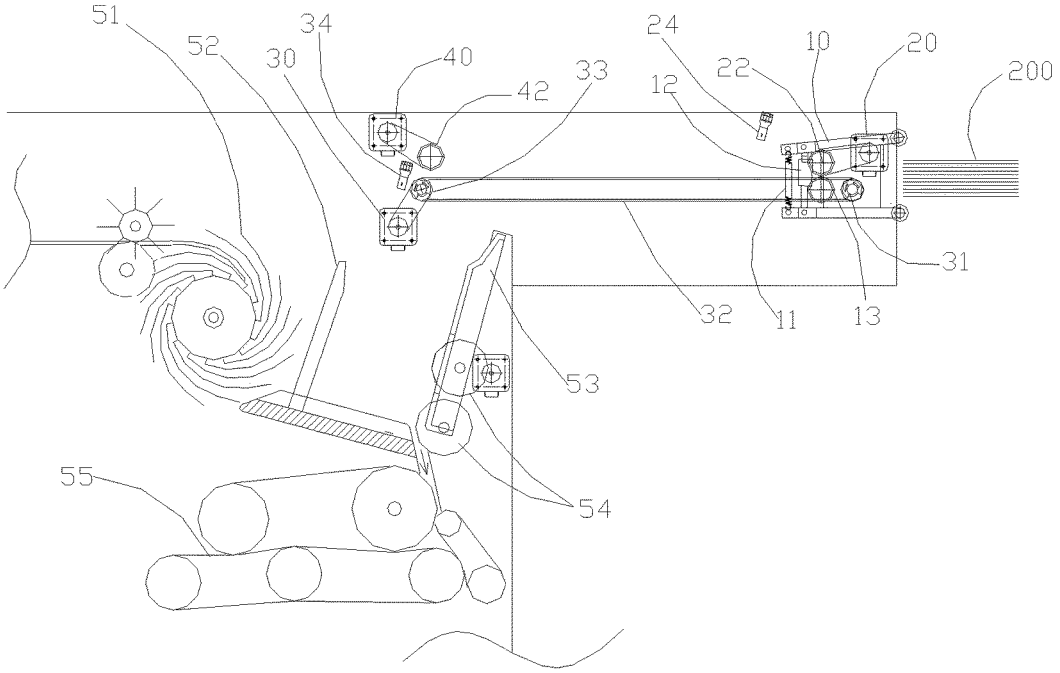
FIG. 3 is a partial view showing the structure of a machine core in FIG. 2 which is embodied as a rotary banknote conveying device.

A using region of the rotary banknote conveying device related to this embodiment is the banknote inlet/outlet 1. FIG. 3 is a schematic partial view showing the structure of the automatic banknote depositing and withdrawing machine in FIG. 2, and mainly shows the rotary banknote conveying device at the banknote inlet/outlet 1 and mechanisms at an inlet of a banknote conveying passage, and FIGS. 5 to 8 show the whole process in which banknotes are conveyed by the rotary conveying device from the banknote inlet/outlet to the inlet of the banknote conveying passage in detail. The structure and conveying process of the rotary banknote conveying device are described in detail hereinafter in conjunction with the drawings.

Figure 4:
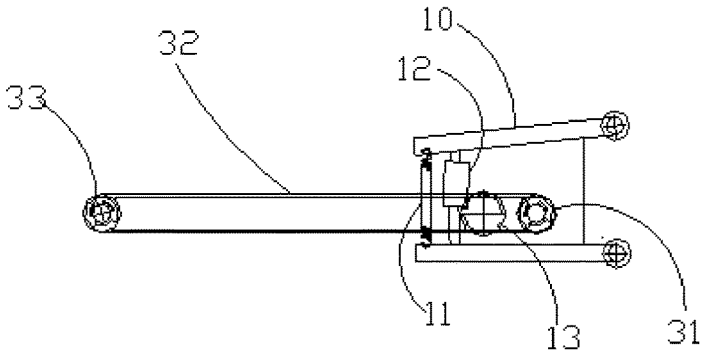
FIG. 4 is a view showing the detailed structure of the rotary banknote conveying device in FIG. 2.

Referring to FIGS. 3 and 4, the rotary banknote conveying device includes a banknote clamping mechanism 10, a transmission mechanism, a first rotary driving mechanism, a second rotary driving mechanism, and a central control mechanism. The banknote clamping mechanism 10 is configured to convey banknotes 200 from the banknote inlet/outlet to the inlet of the banknote conveying passage inside the automatic teller machine. The transmission mechanism includes a drive motor 30, a belt 32 and a pair of pulleys 31 and 33, and the belt 32 is fixed to the banknote clamping mechanism 10 by a shaft and a bearing and is configured to convey the banknote clamping mechanism 10 from the banknote inlet/outlet to the inlet of the banknote conveying passage. The first rotary driving mechanism includes a first rotary motor 20 and a first transmission gear 22, and is configured to drive the banknote clamping mechanism 10 to rotate by a first angle at the banknote inlet/outlet 1. The second rotary driving mechanism includes a second rotary motor 40 and a second transmission gear 42, and is configured to drive the banknote clamping mechanism 10 to rotate by a second angle at the inlet of the banknote conveying passage. The central control mechanism includes a control unit, a first position sensor 24 and a second position sensor 34. The first position sensor 24 is configured to assist in controlling the first rotary driving mechanism to drive the banknote clamping mechanism 10 to rotate by the first angle, and the second position sensor 34 is configured to assist in controlling the second rotary driving mechanism to drive the banknote clamping mechanism 10 to rotate by the second angle. The banknote clamping mechanism 10 is further provided with a transmission gear 13, and the transmission gear 13 is fixed to one side of the banknote clamping mechanism 10 by a shaft. The transmission gear 13 is configured to engage with the first transmission gear 22 or the second transmission gear 42, to drive the banknote clamping mechanism 10 to rotate by the first angle or the second angle. That is, the rotation of the banknote clamping mechanism 10 by the first angle or the second angle is realized in the following manner, the transmission gear 13 selectively engages with the first transmission gear 22 in the first rotary driving mechanism or the second transmission gear 42 in the second rotary driving mechanism, to rotate the banknote clamping mechanism 10, to realize the rotation by the corresponding angles.

Preferably, the banknote clamping mechanism 10 includes an opening end and a rear end opposite to the opening end. In an initial state, as shown in FIG. 3, the opening end faces towards the banknote inlet/outlet, to receive the banknotes 200 placed by a customer, and the rear end opposite to the opening end is close to the inside of the automatic teller machine. The rear end is provided with a spring 11 and an electromagnetic 12 sequentially. The electromagnetic 12 in an energized state is configured to control the banknote clamping mechanism 10 to close, and the spring 11 is configured to control the banknote clamping mechanism 10 to open when the electromagnetic 12 is in a de-energized state. Specifically, the electromagnetic 12 is a common push-pull type electromagnetic, and the spring 11 is a tension spring. The spring 11 is located at a rear end of the clamping mechanism 10, and the electromagnetic 12 is located between the spring 11 and the transmission gear 13. An upper portion and a lower portion of the electromagnetic 12 are fixed to the clamping mechanism 10 by screws. When the power supplied to the electromagnetic 12 is switched on, a pull rod of the electromagnetic 12 extends out, the spring 11 is tensioned, and the clamping mechanism 10 is closed. The clamping force required by the clamping mechanism 10 is provided by the electromagnetic 12. Reversely, when the power supplied to the electromagnetic 12 is switched off, the pull rod of the electromagnetic 12 is withdrawn by the contracting of the spring 11, thus the clamping mechanism 10 is opened.

In addition, as shown in FIG. 3, the inlet of the banknote conveying passage includes a fixed pressing plate 53, a movable pressing plate 52 and a pair of banknote separating wheels 54. The fixed pressing plate 53 and the movable pressing plate 52 define a banknote stacking space. The movable pressing plate 52 can be controlled by an external step motor to move towards the fixed pressing plate 53, to provide a pressing force to press the banknotes in the banknote stacking space tightly. The pair of banknote separating wheels 54 are driven by a step motor to separate the banknotes in the banknote stacking space individually and deliver the banknotes into the banknote conveying passage 55. Furthermore, a delivery impeller 51 is further provided at the inlet of the banknote conveying passage.

Reference is made to FIGS. 3 and 5 to 8, which illustrate a banknote depositing process of the self-service apparatus according to this embodiment in detail hereinafter. The self-service apparatuses mentioned in the present application include, but not limited to, financial self-service apparatuses including an automatic banknote withdrawing machine and an automatic depositing and withdrawing machine. For facilitating the description, this embodiment is described by taking an automatic depositing and withdrawing machine as an example.

Figure 5:
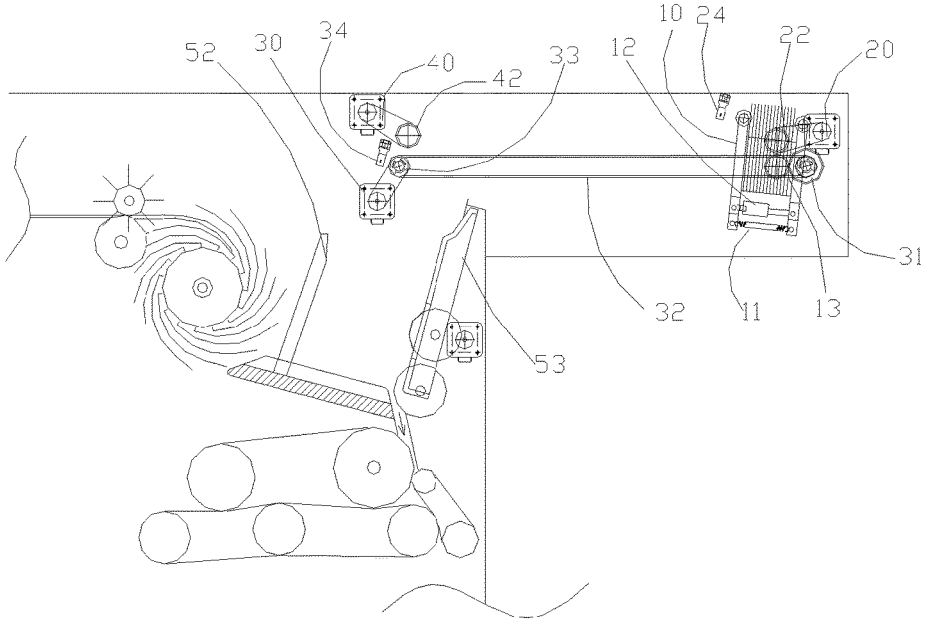
FIG. 5 is a view showing a state in which a banknote clamping mechanism is rotated by a certain angle after banknotes enter the banknote clamping machine.
Figure 6:
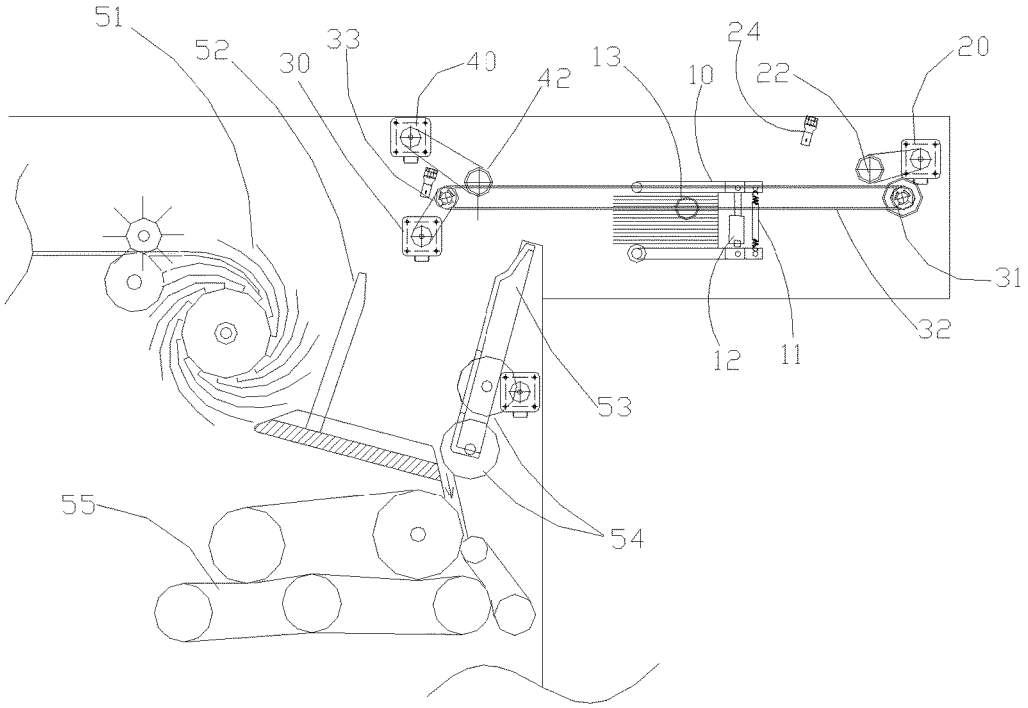
FIG. 6 is a schematic view showing the process of the banknote clamping mechanism being conveyed from a banknote inlet/outlet to an inlet of a banknote conveying passage after the banknote clamping mechanism is rotated by a first angle.

In the case that the automatic depositing and withdrawing machine is on standby, as shown in FIG. 3, the clamping mechanism 10 is opened, and waits for the customer to place the banknotes 200 into the clamping mechanism 10. After a certain time elapses since the sensor senses that the banknotes are placed into the clamping mechanism 10, the electromagnetic 12 is energized, the pull rod of the electromagnetic extends out, the spring 11 is stretched, and the clamping mechanism 10 is closed, thus, the banknotes 200 are clamped by the clamping mechanism. In this case, the first rotary motor 20 starts to drive the first transmission gear 22 to rotate, and at this time, the first transmission gear 22 is engaged with the transmission gear 13, therefore, the first transmission gear 22 drives the transmission gear 13 to rotate, thereby driving the clamping mechanism 10 and the banknotes 200 to rotate, as shown in FIG. 5. When the clamping mechanism 10 reaches the position of the first sensor 24, the clamping mechanism 10 finishes the rotation by the first angle, and then stops rotating, and at this time, the banknotes 200 are also rotated to face directly the rear side, and the position and angle of the banknotes are shown in FIG. 6. When the banknote clamping mechanism 10 stops rotating, the banknotes 200 face directly the rear side, and the banknote clamping mechanism 10 is conveyed from the banknote inlet/outlet to the inlet of the banknote conveying passage inside the apparatus by a transmission mechanism consisting of a drive motor 30, a synchronous belt 32 and synchronous pulleys 31 and 33. The synchronous pulleys 31 and 33 are located at a front side and a rear side of the banknote dispensing portion respectively, and are fixed to a frame of the machine. FIG. 6 is a schematic view showing the conveyed process of the banknote clamping mechanism 10.

Figure 7:
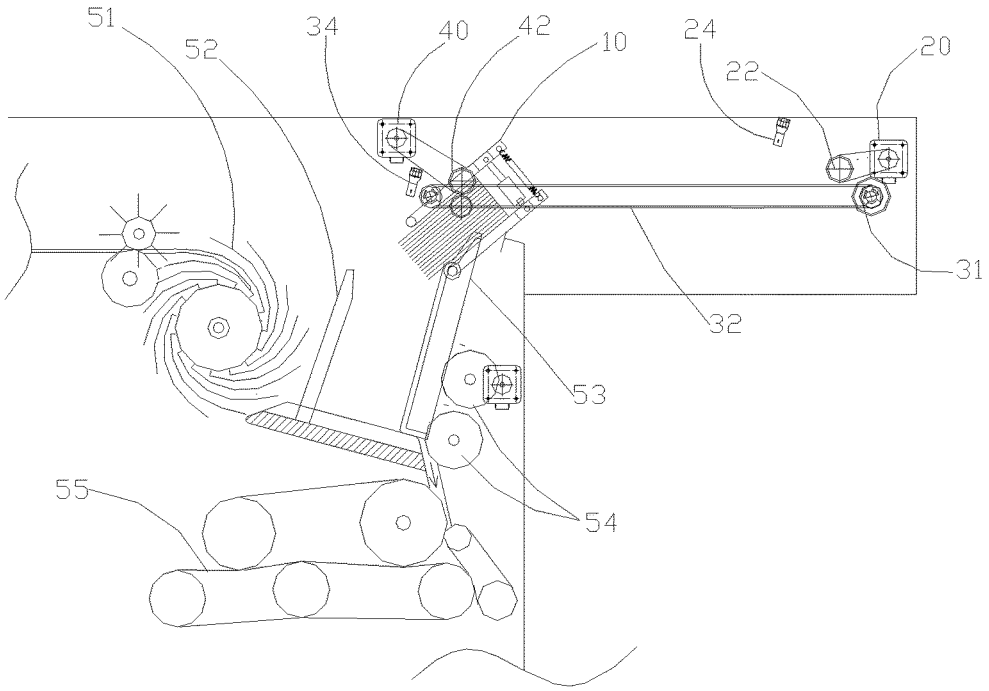
FIG. 7 is a view showing a state in which the banknote clamping mechanism is conveyed to the inlet of the banknote conveying passage and is rotated by a second angle.
Figure 8:
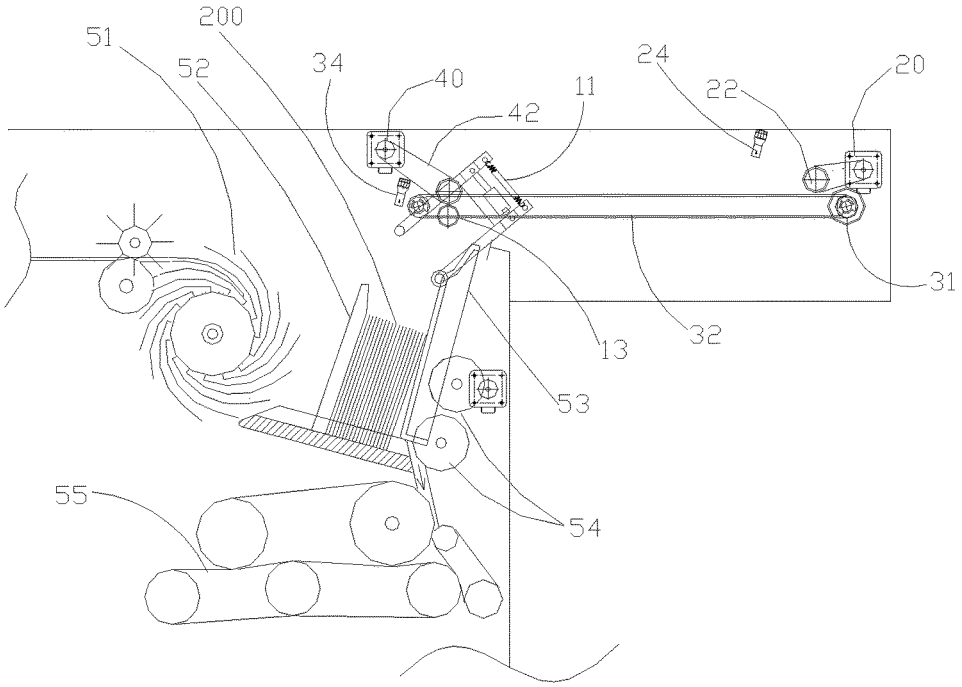
FIG. 8 is a schematic view showing that the banknote clamping device drops banknotes into a banknote accommodating space at the inlet of the banknote conveying passage.

Referring to FIGS. 7 and 8, when the banknote clamping mechanism 10 is conveyed in position, the second rotary motor 40 starts to drive the second transmission gear 42 to rotate, and at this time, the second transmission gear 22 is engaged with the transmission gear 13, therefore, the second transmission gear 42 drives the transmission gear 13 to rotate, thereby driving the clamping mechanism 10 and the banknotes 200 to further rotate. When the banknote clamping mechanism 10 reaches the position of the second sensor 34, the banknote clamping mechanism 10 stops rotating. At this time, the banknote clamping mechanism 10 clamping the banknotes 200 finishes the rotation by the second angle, as shown in FIG. 7. At this time, the power for the electromagnetic of the banknote clamping mechanism 10 is switched off, and the spring 11 contracts and pulls the banknote clamping mechanism 10 to be opened, and the banknotes 200 fall into, by gravity, the banknote stacking space defined by the fixed pressing plate 53 and the movable pressing plate 52, as shown in FIG. 8. In this way, the rotary banknote conveying device finishes the process for conveying the banknotes 200 from the banknotes inlet/outlet into the inlet of the banknote conveying passage inside the apparatus. Then, the motor rotates reversely to drive the banknote clamping mechanism 10 to rotate reversely and return to the standby position, and this process is an inverse process of the banknote conveying process, and will not be described in detail here.

The rotary banknote conveying device according to this embodiment achieves the conveying of the clamping mechanism by the step motor and the synchronous belt, and has a higher stability and a higher accuracy compared with a conventional gear-rack transmission. Further, the design concept of conveying banknotes by the rotating manner is ingenious. In addition, the closing and opening of the clamping mechanism are controlled by the electromagnetic and the spring, thereby eliminating the conventional motor control method and the like, thus the cost is lower, and the reliability is higher.

The above embodiments are only preferable embodiments of the present application and are not intended to limit the scope of the present application. Any equivalent variations made based on the specification and drawings of the present application should be deemed to fall into the scope of protection the present application defined by the claims.

The invention claimed is:

1. A rotary banknote conveying device, applicable to a banknote inlet/outlet of an automatic teller machine, the rotary banknote conveying device comprising:

a banknote clamping mechanism configured to convey banknotes from the banknote inlet/outlet to an inlet of a banknote conveying passage inside the automatic teller machine;

a transmission mechanism comprising a drive motor, a belt and a pair of pulleys, the belt being fixed to the banknote clamping mechanism by a shaft and a bearing and configured to convey the banknote clamping mechanism from the banknote inlet/outlet to the inlet of the banknote conveying passage;

a first rotary driving mechanism comprising a first rotary motor and a first transmission gear and configured to drive the banknote clamping mechanism to rotate by a first angle at the banknote inlet/outlet;

a second rotary driving mechanism comprising a second rotary motor and a second transmission gear and configured to drive the banknote clamping mechanism to rotate by a second angle at the inlet of the banknote conveying passage; and a central control mechanism comprising a control unit, a first position sensor configured to assist in controlling the first rotary driving mechanism to drive the banknote clamping mechanism to rotate by the first angle, and a second position sensor configured to assist in controlling the second rotary driving mechanism to drive the banknote clamping mechanism to rotate by the second angle.

2. The rotary banknote conveying device according to claim 1, wherein the banknote clamping mechanism is provided with a transmission gear, and the transmission gear is configured to engage with the first transmission gear or the second transmission gear, to drive the banknote clamping mechanism to rotate by the first angle or the second angle.

3. The rotary banknote conveying device according to claim 2, wherein the banknote clamping mechanism further comprises an opening end and a rear end opposite to the opening end, the rear end is provided with a spring and a electromagnetic sequentially, the electromagnetic is configured to control the banknote clamping mechanism to close in a state that the electromagnetic is energized, and the spring is configured to control the banknote clamping mechanism to open in a state that the electromagnetic is de-energized.

4. The rotary banknote conveying device according to claim 3, wherein the inlet of the banknote conveying passage comprises a fixed pressing plate, a movable pressing plate and a pair of banknote separating wheels, the fixed pressing plate and the movable pressing plate define a banknote stacking space, and the pair of banknote separating wheels are driven by a step motor to separate the banknotes in the banknote stacking space individually and deliver the banknotes into the banknote conveying passage.

5. The rotary banknote conveying device according to claim 2, wherein the inlet of the banknote conveying passage comprises a fixed pressing plate, a movable pressing plate and a pair of banknote separating wheels, the fixed pressing plate and the movable pressing plate define a banknote stacking space, and the pair of banknote separating wheels are driven by a step motor to separate the banknotes in the banknote stacking space individually and deliver the banknotes into the banknote conveying passage.

6. The rotary banknote conveying device according to claim 1, wherein the inlet of the banknote conveying passage comprises a fixed pressing plate, a movable pressing plate and a pair of banknote separating wheels, the fixed pressing plate and the movable pressing plate define a banknote stacking space, and the pair of banknote separating wheels are driven by a step motor to separate the banknotes in the banknote stacking space individually and deliver the banknotes into the banknote conveying passage.

* * * * *